US009423764B2

(12) United States Patent
Abe et al.

(10) Patent No.: US 9,423,764 B2
(45) Date of Patent: Aug. 23, 2016

(54) IMAGE FORMING APPARATUS

(71) Applicant: CANON KABUSHIKI KAISHA, Tokyo (JP)

(72) Inventors: Tsukasa Abe, Yokohama (JP); Hiroyuki Matsumoto, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/822,037

(22) Filed: Aug. 10, 2015

(65) Prior Publication Data

US 2016/0039624 A1 Feb. 11, 2016

(30) Foreign Application Priority Data

Aug. 11, 2014 (JP) ..... 2014-163549

(51) Int. Cl.

*G03G 21/16* (2006.01)
*G03G 21/18* (2006.01)
*G03G 15/00* (2006.01)

(52) U.S. Cl.

CPC ..... *G03G 21/1633* (2013.01); *G03G 15/6502* (2013.01)

(58) Field of Classification Search

CPC ..... G03G 21/18
See application file for complete search history.

(56) References Cited

U.S. PATENT DOCUMENTS

| | | | | |
|---|---|---|---|---|
| 7,529,505 | B2 | 5/2009 | Okamoto | |
| 8,737,879 | B2 | 5/2014 | Ito et al. | |
| 9,086,675 | B2 | 7/2015 | Okabe | |
| 2014/0201946 | A1 * | 7/2014 | Yabukoshi | E05F 1/1261 16/304 |

FOREIGN PATENT DOCUMENTS

| | | | |
|---|---|---|---|
| JP | H4-214549 | A | 8/1992 |
| JP | 2002-111241 | A | 4/2002 |
| JP | 2006-259148 | A | 9/2006 |
| JP | 2007-310017 | A | 11/2007 |
| JP | 2010-217743 | A | 9/2010 |
| JP | 2012-126027 | A | 7/2012 |
| JP | 2012-198444 | A | 10/2012 |

* cited by examiner

*Primary Examiner* — David Gray
*Assistant Examiner* — Michael Harrison
(74) *Attorney, Agent, or Firm* — Fitzpatrick, Cella, Harper & Scinto

(57) ABSTRACT

An image forming apparatus includes a main assembly; a rotatable member supported by the main assembly rotatably about a first rotational center; an openable member supported by the rotatable member rotatably about a second rotational center; and an urging member provided between the openable member and the rotatable member and configured to apply an urging force for suppressing opening of the openable member, wherein the openable member is capable of switching a rotational center between the first rotational center and the second rotational center in opening and closing operation of the openable member.

13 Claims, 9 Drawing Sheets

IMAGE FORMING APPARATUS

FIELD OF THE INVENTION AND RELATED ART

The present invention relates to an image forming apparatus having a component which can be opened or closed.

Generally speaking image forming apparatuses have an image forming section which forms an image on a recording medium, and a recording medium feeding-conveying section which feeds a sheet of recording medium into the main assembly of the apparatus and conveys the sheet to the image forming section. Some image forming apparatuses are structured so that an image formation unit which functions as an image forming section, and a recording medium feeding-conveying tray, are removably mountable in the main assembly of the apparatus.

Also generally speaking, image forming apparatuses are equipped with a door (component which can be opened or closed relative to main assembly of apparatus), which is for allowing an image formation unit to be removably installed in the main assembly of the apparatus. The image forming apparatuses disclosed in Japanese Laid-open Patent Applications 2012-198444 and 2006-259148 are structured so that the space through which their door moves as the door is opened or closed overlaps with the space through which their recording medium feeding-conveying tray moves as the tray is mounted into, or dismounted from, their main assembly. If a user tries to open the door further after the door comes into contact with the tray, the tray is subjected to a substantial amount of load by the door.

That is, conventionally structured image forming apparatuses are problematic in that it is possible that their recording medium feeding-conveying tray will be damaged, and therefore, be reduced in recording medium feeding-conveying performance. Moreover, as an image forming apparatus is reduced in size, it is reduced in the distance between a process cartridge, which functions as an image formation unit, and a recording medium feeding-conveying tray. Thus, it becomes necessary to structure an image forming apparatus so that its door can be opened wider, and/or the rotational axis of the hinge portion of the door is placed closer to the tray, than in the case of an image forming apparatus of a larger size. As an image forming apparatus is structured so that its door can be opened wider, and/or the rotational axis of the door is placed closer to the tray, it is more likely for the door and tray to interfere with each other.

SUMMARY OF THE INVENTION

The present invention is for solving the above described problem, and its primary object is to provide an image forming apparatus which is significantly smaller in the amount of the load to which a component, or components, other than its door for installing or uninstalling an image formation unit (cassette), is subjected as the door comes into contact into the other components, than any conventional image forming apparatus.

According to an aspect of the present invention, there is provided an image forming apparatus comprising a main assembly; a rotatable member supported by said main assembly rotatably about a first rotational center; an openable member supported by said rotatable member rotatably about a second rotational center; and an urging member provided between said openable member and said rotatable member and configured to apply an urging force for suppressing opening of the openable member, wherein said openable member is capable of switching a rotational center between the first rotational center and the second rotational center in opening and closing operation of said openable member.

According to another aspect of the present invention, there is provided an image forming apparatus comprising a main assembly; an openable member openable and closable relative to said main assembly; a rotatable member configured to rotate said openable member relative to said main assembly; a hole portion which is provided in said main assembly and through which a rotational shaft portion of said rotatable member is slidably inserted; and an urging member provided between said main assembly and said rotatable member and configured to apply an urging force for suppressing opening of the openable member, wherein the rotation of said openable member is switched in response to an urging force of said urging member between rotation about said rotational shaft portion without movement along said hole portion and rotation about said rotational shaft portion with movement along said hole portion.

Further features of the present invention will become apparent from the following description of exemplary embodiments with reference to the attached drawings.

Figure 2:
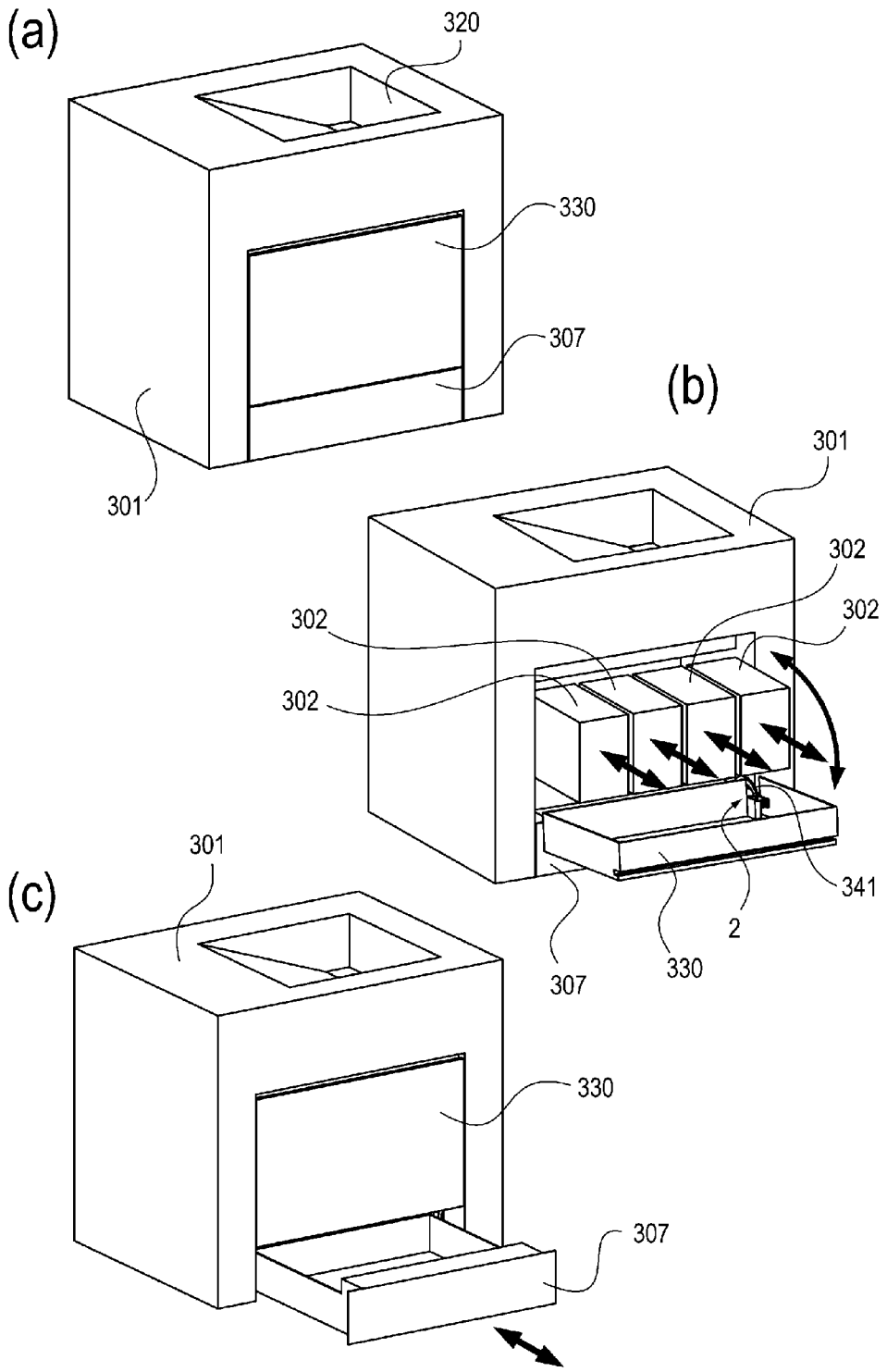

Part (a) of FIG. 2 is a perspective view of the image forming apparatus in the first embodiment when the door of the apparatus, which is for installing or uninstalling the process cartridges, is closed, and the recording medium feeding-conveying tray of the apparatus is completely inside the main assembly of the apparatus. Part (b) of FIG. 2 is a perspective view of the image forming apparatus in the first embodiment when the recording medium feeding-conveying tray of the apparatus is completely inside the main assembly of the apparatus, and the door of the apparatus, which is for the installation or uninstallation of the process cartridges, is open for allowing process cartridges to be installed into, or uninstalled from, the main assembly of the apparatus. Part (c) of FIG. 2 is a perspective view of the image forming apparatus in the first embodiment, when the door of the apparatus, which is for the installation or uninstallation of process cartridges is closed, and the recording medium feeding-conveying tray of the apparatus is not completely inside the main assembly of the apparatus.

Figure 3:
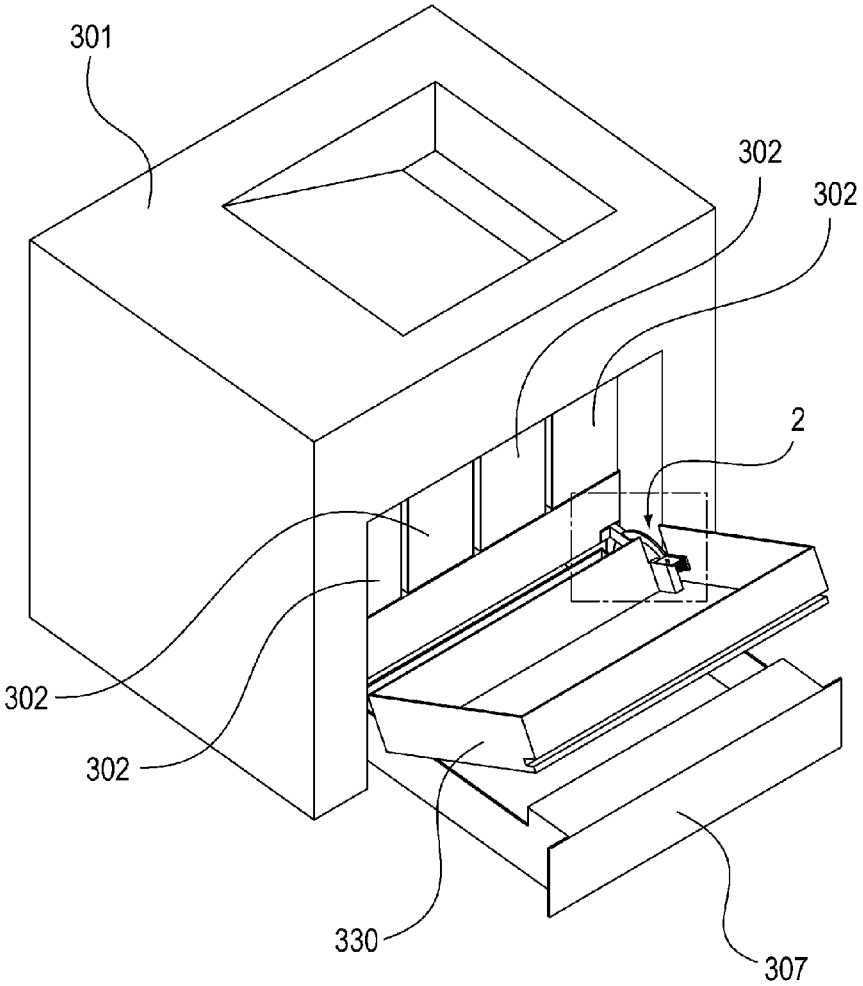

FIG. 3 is a schematic perspective view of the image forming apparatus in the first embodiment, when the door of the apparatus, which is for installing or uninstalling process cartridges is open while the recording medium feeding-conveying tray of the apparatus is not completely inside the main assembly of the apparatus.

Figure 4:
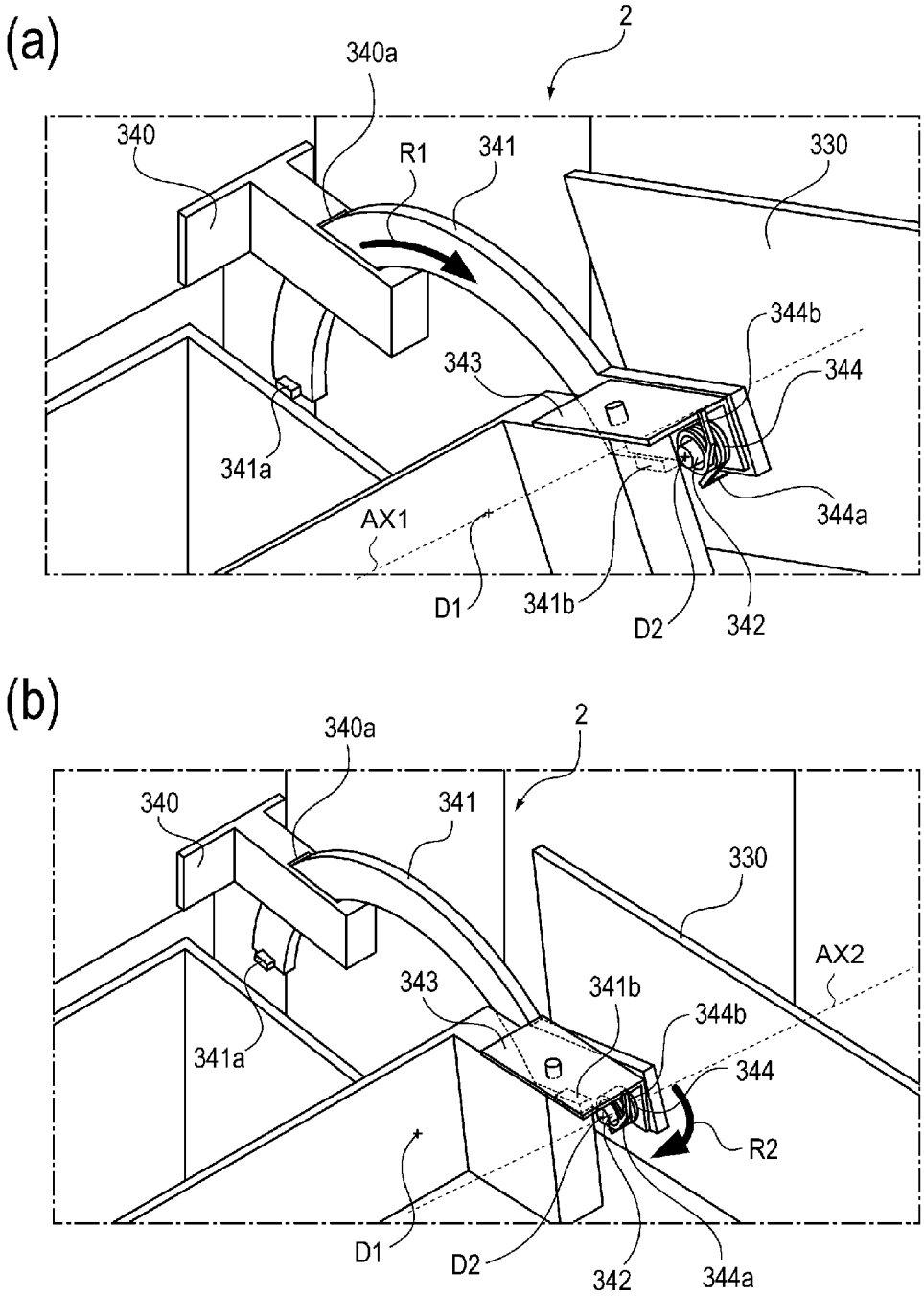

Part (a) of FIG. 4 is a perspective view of the door assembly of the image forming apparatus in the first embodiment, which is for describing the rotational movement of the roughly semicircular arm, door, etc., of the door assembly, which occurs when the door does not come into contact with the recording medium feeding-conveying tray of the apparatus. Part (b) of FIG. 4 is a perspective view of the door assembly of the image forming apparatus in the first embodiment, which is for describing the rotational movement of the roughly semicircular arm, door, etc., of the door assembly, which occurs when the door comes into contact with the recording medium feeding-conveying tray of the apparatus.

Figure 5:
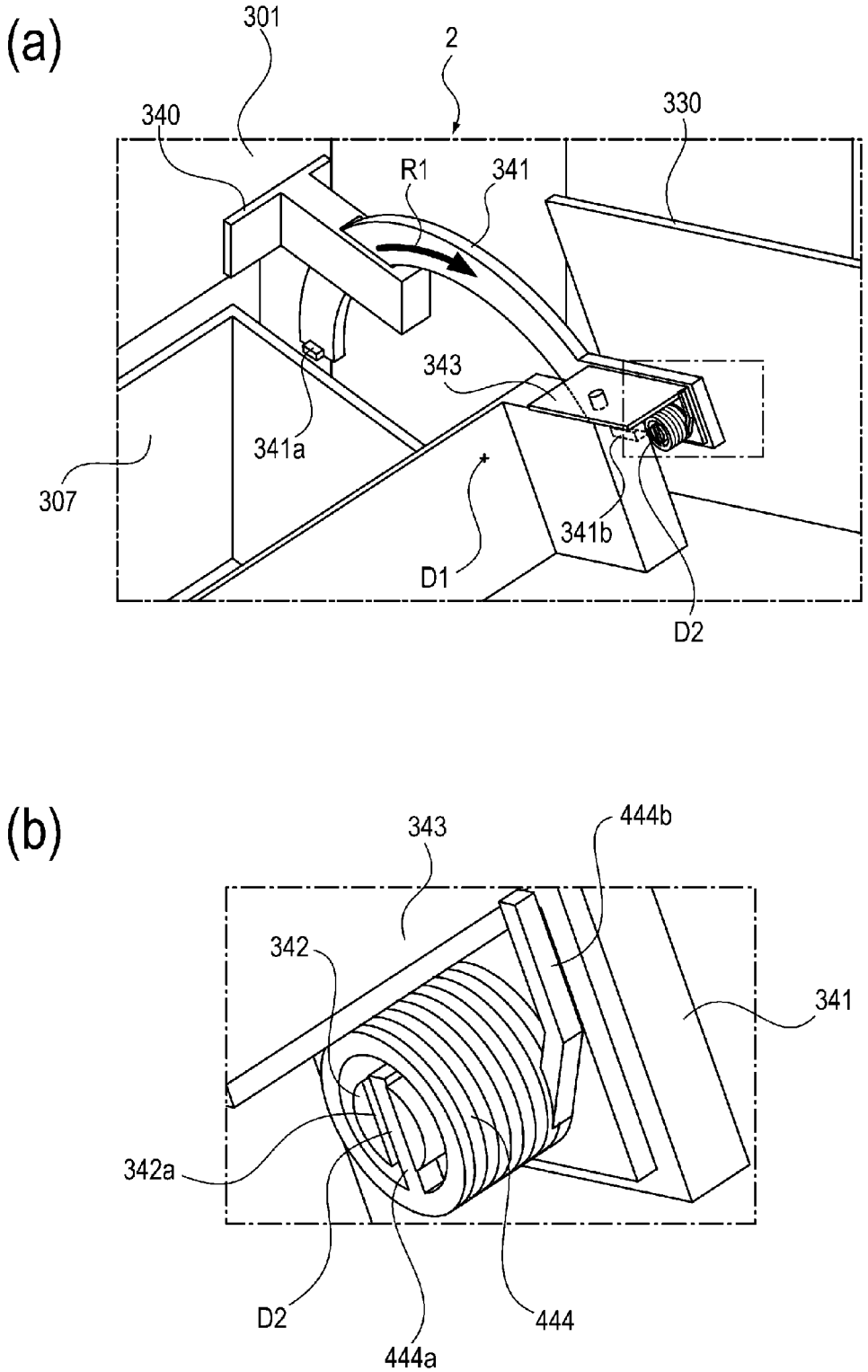

Part (a) of FIG. 5 is a perspective view of the door assembly of the image forming apparatus in the second embodiment, which is for describing the rotational movement of the roughly semicircular arm, door, etc., of the door assembly, which occurs when the door does not come into contact with the recording medium feeding-conveying tray of the apparatus. Part (b) of FIG. 5 is an enlarged perspective view of the pressure applying means, and its adjacencies, of the image forming apparatus in the second embodiment, and shows the structure of the means.

Figure 6:
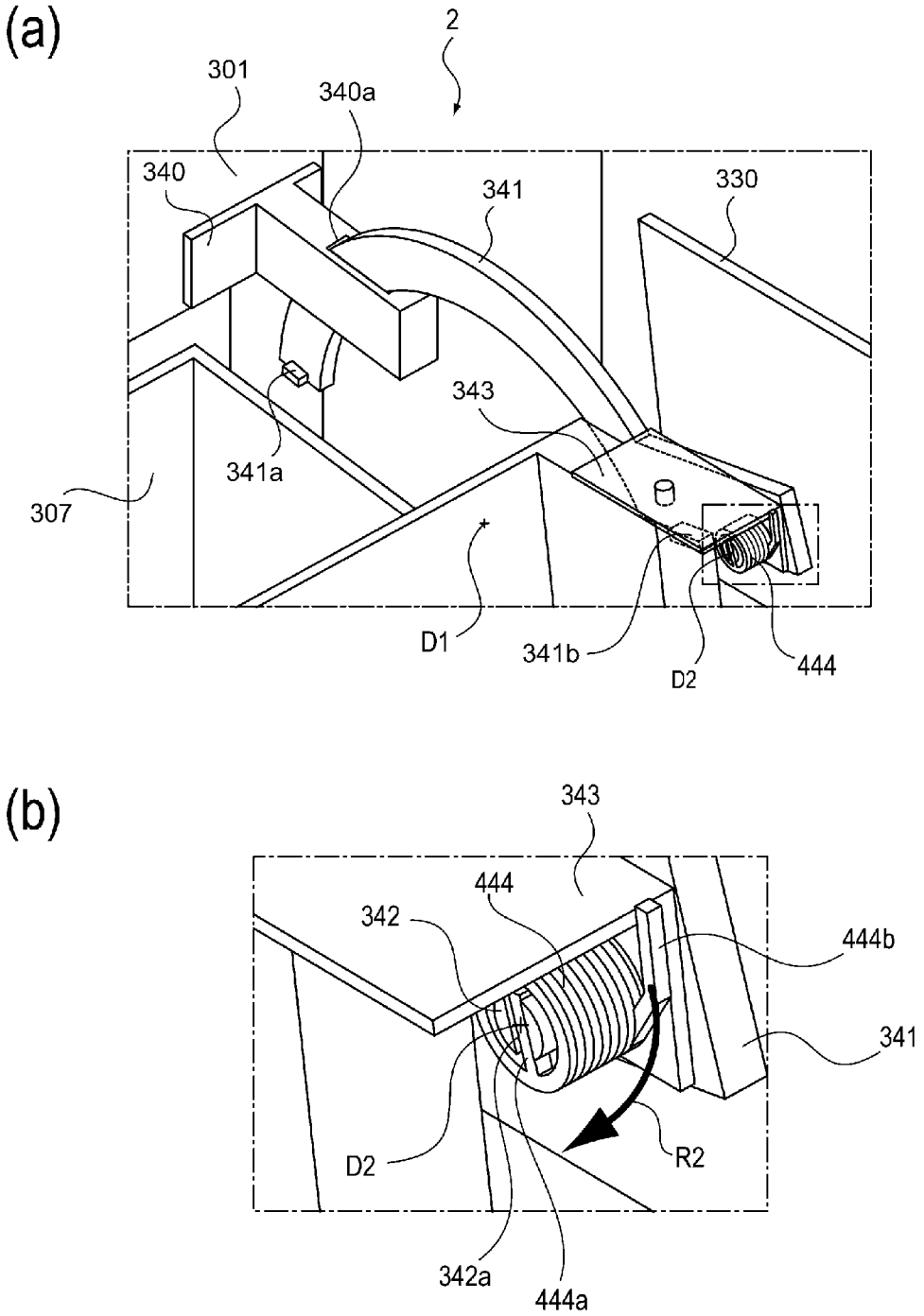

Part (a) of FIG. 6 is a perspective view of the door assembly of the image forming apparatus in the second embodiment 444, which is for describing the rotational movement of the roughly semicircular arm, door, etc., of the door assembly, which occurs when the door comes into contact with the recording medium feeding-conveying tray of the apparatus. Part (b) of FIG. 6 is an enlarged perspective view of the pressure applying means, and its adjacencies, of the image forming apparatus in the second embodiment, and shows the structure of the means.

Figure 7:
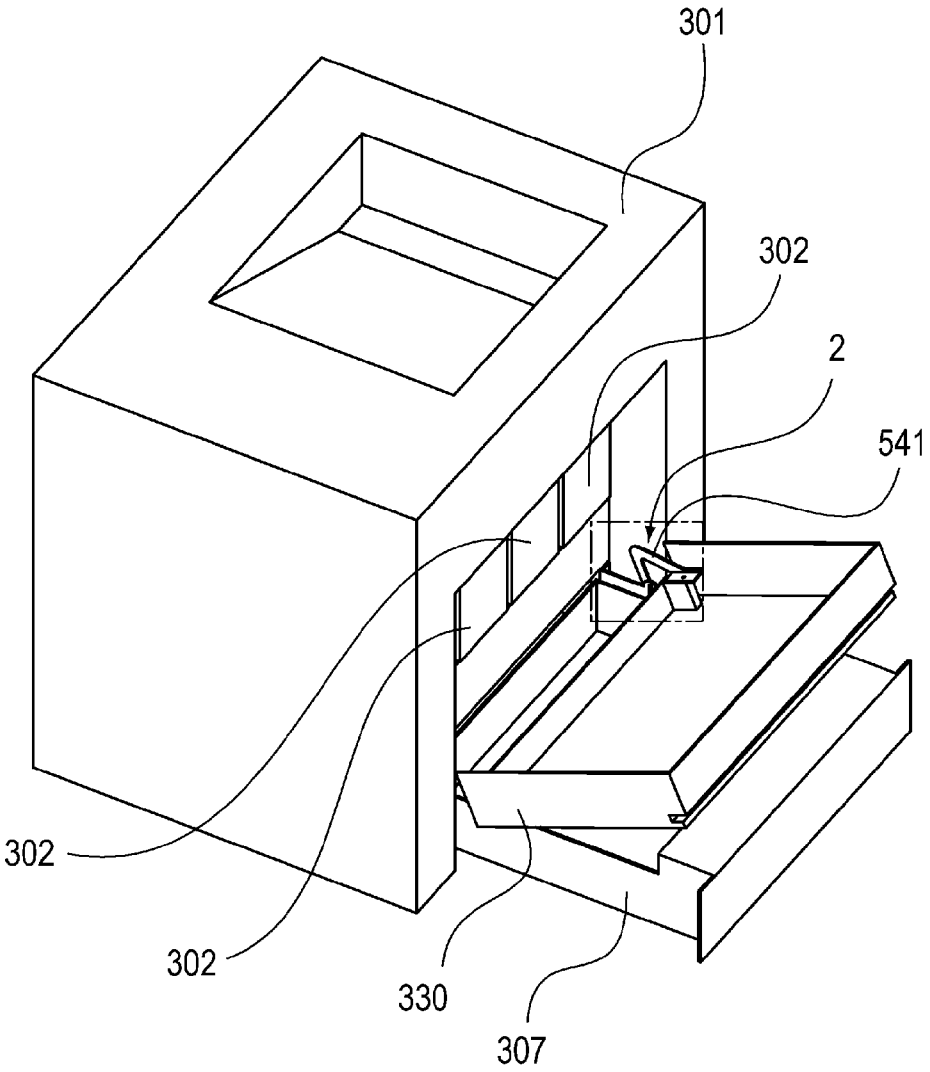

FIG. 7 is a perspective view of the image forming apparatus in the third embodiment of the present invention when the door of the apparatus is opened while the recording medium feeding-conveying tray is not completely inside the main assembly of the apparatus.

Figure 8:
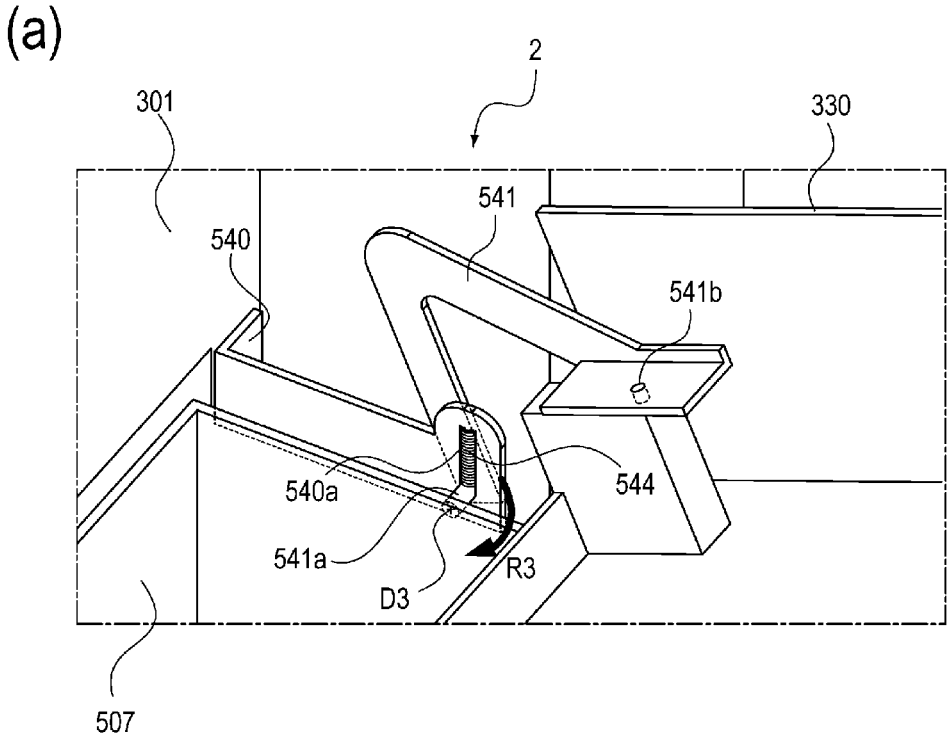
Figure 8:
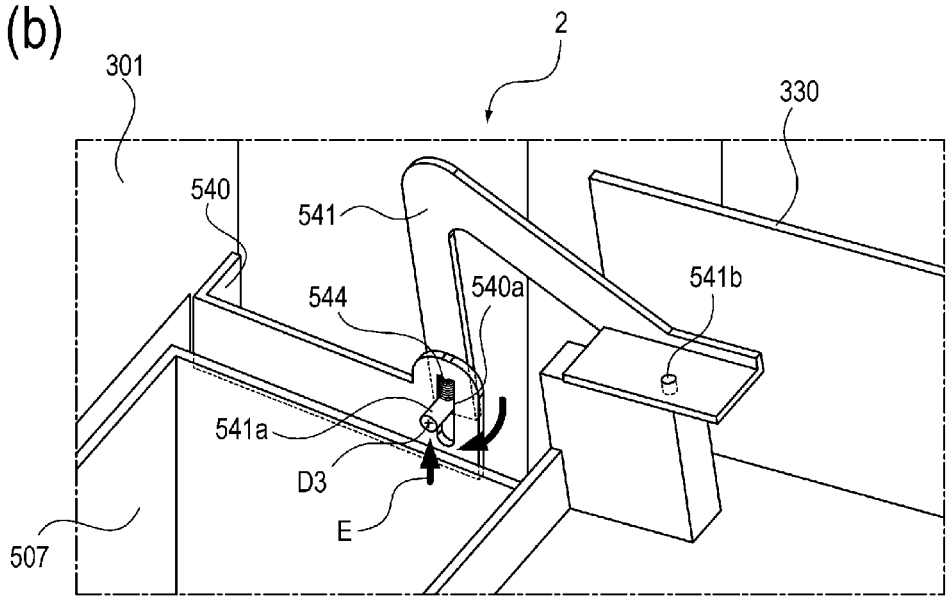

Part (a) of FIG. 8 is a perspective view of the door assembly of the image forming apparatus in the third embodiment, which is for describing the rotational movement of the roughly semicircular arm, door, etc., of the door assembly, which occurs when the door does not comes into contact with the recording medium feeding-conveying tray of the apparatus. Part (b) of FIG. 8 is a perspective view of the door assembly of the image forming apparatus in the third embodiment, which is for describing the rotational movement of the roughly semicircular arm, door, etc., of the door assembly, which occurs when the door comes into contact with the recording medium feeding-conveying tray of the apparatus.

Figure 9:
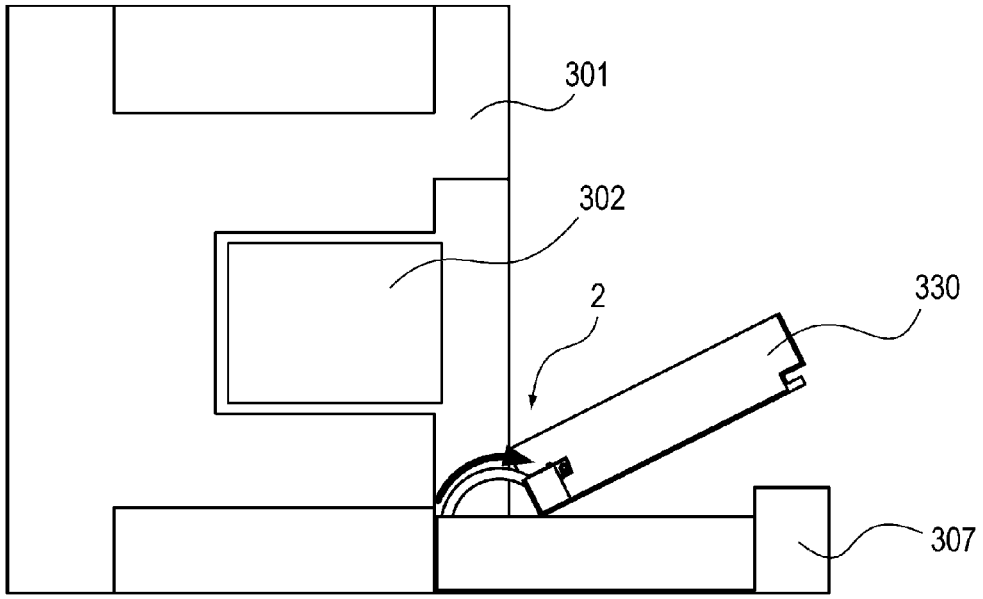

FIG. 9 is a schematic sectional view of the comparative image forming apparatus when the door of the apparatus is opened while the recording medium feeding-conveying tray is not completely inside the main assembly of the apparatus.

DESCRIPTION OF THE EMBODIMENTS

Hereinafter, a few of the image forming apparatuses which are in accordance with the present invention are concretely described. By the way, the measurement, material, and shape of each of the structural components of each of the image forming apparatuses in the following embodiments, the positional relationship among the structural components, etc., are not intended to limit the present invention in scope.

[Embodiment 1]

Figure 1:
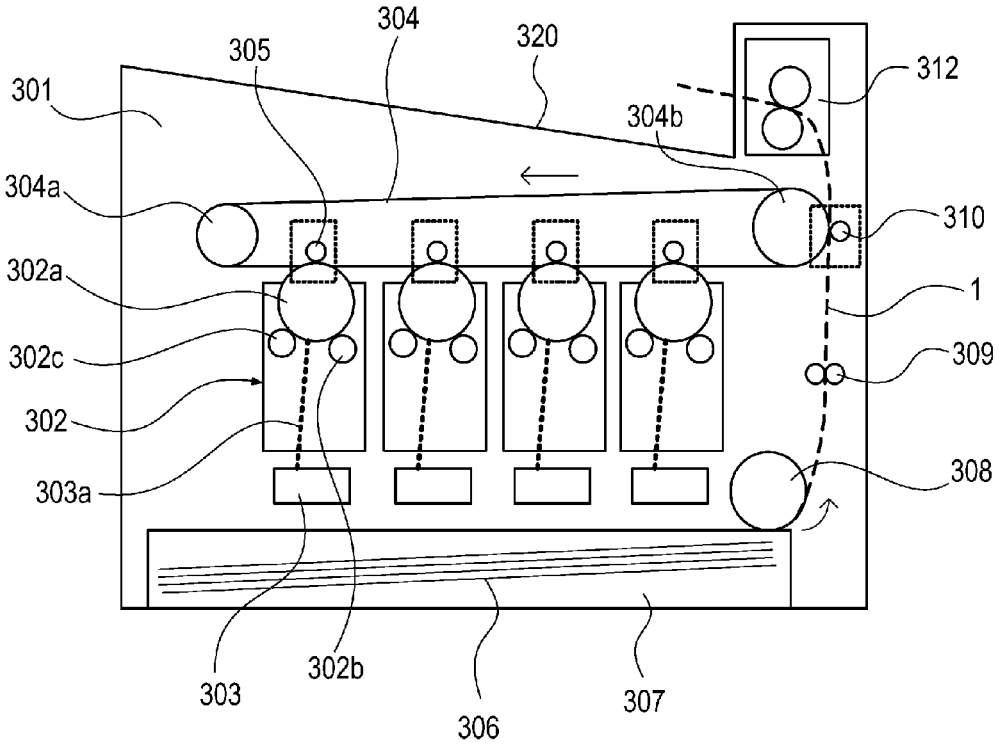
FIG. 1 is a sectional view of the image forming apparatus in the first embodiment of the present invention, and shows the general structure of the apparatus.

To begin with, referring to FIGS. 1-4, the image forming apparatus in the first embodiment of the present invention is described about its structure. The image forming apparatus 301 shown in FIGS. 1-3 is an example of color laser printer which uses an electrophotographic image forming method.

<Image Forming Apparatus>

FIG. 1 is a sectional view of the image forming apparatus 301, and shows the structure of the apparatus. In FIG. 1, a referential code 302 stands for one of the process cartridges which are removably installable in the main assembly of the image forming apparatus 301 in FIGS. 1-3. A referential code 330 stands for a door 330 which is pivotally hinged to the main assembly of the image forming apparatus 301 so that it can be opened to allow the process cartridges 302 to be installed into, or uninstalled from, the main assembly.

Each process cartridge 302 contains a photosensitive drum 302*a* which functions as an image bearing member. Each process cartridge 302 contains: a charge roller 302*b* which functions as a charging means for uniformly charging the peripheral surface of the photosensitive drum 302*a;* a laser scanner 303 which functions as an exposing means which projects a beam 303*a* of laser light upon the uniformly charged peripheral surface of the photosensitive drum 302*a* while modulating the beam 303*a* according to the information of the image to be formed; and a development roller 302*c*, as a developer bearing member, which functions as a developing means for developing an electrostatic latent image formed on the peripheral surface of the photosensitive drum 302*a* by the beam 303*a* of laser light projected from the laser scanner 303, into a toner image by supplying the electrostatic latent image with toner (developer). The charge roller 302*b*, laser scanner 303, and development roller 302*c* are disposed in the adjacencies of the peripheral surface of the photosensitive drum 302*a*.

The electrostatic latent image formed on the peripheral surface of the photosensitive drum 302*a* by the beam 303*a* of laser light projected from the laser scanner 303 while being modulated according to the information of the image to be formed is developed into a toner image, on the peripheral surface of the photosensitive drum 302*a*, by the toner supplied to the electrostatic latent image through one of the known image formation processes. An ordinary color laser printer employs four process cartridges 303 which form yellow, magenta, cyan and black toner images, one for one.

The image forming apparatus 301 is provided with an intermediary transfer belt 304, which is suspended and kept tensioned by a pair of rollers 304*a* and 304*b*, being enabled to be circularly moved, on the top side of the four photosensitive drums 302*a*. Further, the image forming apparatus 301 is provided with four primary transfer rollers 305 which function as primary transferring means. The four primary transfer rollers 305 are disposed on the inward side of the loop which the intermediary transfer belt 304 forms, in such a manner that they oppose the corresponding photosensitive drums 302*a*. As primary transfer bias voltage is applied to the primary transfer roller 305, the toner formed on the peripheral surface of the corresponding photosensitive drum 302*a* is transferred onto the outward surface of the intermediary transfer belt 304. That is, four toner images, different in color, are sequentially transferred onto the outward surface of the intermediary transfer belt 304, effecting thereby a multicolor image on the outward surface of the intermediary transfer belt 304.

Further, the image forming apparatus 301 in FIG. 1 is provided with a recording medium feeding-conveying tray 307 in which multiple sheets 306 of recording medium are storable. The recording medium feeding-conveying tray 307, which hereafter will be referred to simply as a sheet feeding tray 307, is removably installable in the main assembly of the image forming apparatus 301. As a sheet feeder roller 308 disposed in the adjacencies of the leading edge (right end in FIG. 1) of the sheets 306 of recording medium in the sheet feeder tray 307 in FIG. 1 is rotated, one or more of the sheets 306 are moved out of the tray 307, and then, are moved one by one into the main assembly of the image forming apparatus 301, by the coordination between the sheet feeder roller 308 and an unshown separating means. Thereafter, each sheet 306 is conveyed further downstream by a pair of registration rollers 309 with a preset timing.

Further, the image forming apparatus 301 is provided with a secondary transfer roller 310 which functions as the secondary transferring means. The secondary transfer roller 310 is disposed so that it opposes the intermediary transfer belt 304. Each sheet 306 of recording medium is conveyed by the pair of registration rollers 309 with such a timing that the sheet 306 arrives at the secondary transfer nip at the same time as the toner images on the outward surface of the intermediary transfer belt 304. Then, as the secondary transfer bias voltage is applied to the secondary transfer roller 310, the toner image on the outward surface of the intermediary transfer belt 304 is transferred onto the sheet 306.

After an unfixed toner image was formed on the outward surface of the intermediary transfer belt 304, and was transferred onto the sheet 306 of recording medium, the sheet 306 is conveyed further downstream, and then is subjected to heat and pressure by a fixing device 312 which functions as a fixing means. Thus, the toner (toner image) is melted. Then, as the melted toner cools down, it becomes fixed to the sheet 306. Thereafter, the sheet 306 is discharged onto a delivery tray 320. That is, an image is formed on the surface of the sheet 306 through an image forming operation comprising the above described sequential steps.

Parts (a)-(c) of FIG. 2 are schematic perspective views of the image forming apparatus 301, when the door 330 is closed and the sheet feeder tray 307 is completely inside the main assembly of the apparatus, when the door 330 is open wide enough for the process cartridges 302 to be installed into, or uninstalled, from the main assembly of the image forming apparatus 301, when the sheet feeder tray 307 is not completely inside the main assembly, and when the door 330 is closed, and the sheet feeder tray 307 is not completely inside the main assembly of the apparatus, respectively. More concretely, part (a) of FIG. 2 shows the image forming apparatus 301 when the door 330 is closed, and the sheet feeder tray 307 is entirely in the main assembly of the image forming apparatus 301. Referring to part (b) of FIG. 2, the door 330 can be pivotally moved away from (opened), or pivotally moved toward (closed), the main assembly of the image forming apparatus 301. The door 330 is opened wider than it needs to be opened to provide a space which is large enough for the process cartridges 302 to be replaced, that is, to be installed into, or uninstalled from, the main assembly. That is, the image forming apparatus 301 is structured so that the door 330 can be opened wide enough to intrude into the path of the sheet feeder tray 307.

Referring to part (c) of FIG. 2, the image forming apparatus 301 is structured so that the sheet feeder tray 307 in which sheets 306 are stored can be installed into, or uninstalled from (toward, or away from, user in part (c) of FIG. 2), the main assembly of the image forming apparatus 301, in the horizontal direction, that is, the direction which is roughly perpendicular to the direction (vertical direction in FIG. 1) in which the sheet 306 is conveyed through a recording medium conveyance passage 1 shown in FIG. 1.

<Hinge Portion of Door>

Next, referring to FIGS. 3, 4(*a*) and 4(*b*), the structure of the hinge portion 2 of the door 330 in this embodiment is described. Referring to FIGS. 3, 4(*a*) and 4(*b*), a door supporting section 340 is fixed to the main assembly of the image forming apparatus 301. It is provided with a through hole 340*a* which is shaped in such a manner that its cross section which is perpendicular to the front surface of the door 330 has such a curvature that is equal to the curvature of a circle which has a preset radius, and, the center of which coincides with the first axis D1 of rotation, shown in part (a) of FIG. 4.

The door 330 is provided with a pair of arms 341, each of which is put through the through hole 340*a* of the supporting section 340. The arm 341 is roughly semicircular. More specifically, its cross section perpendicular to the direction in which the door 330 is opened or closed is rectangular, and its vertical cross section parallel to the direction of the door movement has such a curvature that is equal to the curvature of the above described circle which has the preset radius, and, the center of which coincides with the first axis D1 of rotation, shown in part (a) of FIG. 4. Thus, as the door 330 is opened or closed, the semicircular arm 341 can slide through the through hole 340*a*. With the supporting section 340 and arm 341 being structured as described above, the door 330 is supported by the supporting section 340 and arms 341 in such a manner that it is allowed to pivotally move relative to the main assembly of the image forming apparatus 301, about a hypothetical axis AX1 which coincides with the first axis D1 of rotation shown in part (a) of FIG. 4.

The arm 341 is provided with a pair of rotation stoppers 341*a* and 341*b*, which protrude from the lengthwise ends of the arm 341, one for one. As the door 330 is pivotally moved (opened), the rotation stopper 341*a* comes into contact with the bottom surface of the supporting section 340, more specifically, the portion of the bottom surface of the supporting section 340, which is next to the through hole 340*a*, controlling thereby the arm 341 in the angle of its rotational movement. The opposite end of the arm 341 from the rotation stopper 341*a* is provided with a shaft 342, which protrudes from the arm 341, inward of the main assembly of the image forming apparatus 301. This shaft 342 is put through an unshown through hole, with which one end of a door anchoring section (bracket) 343 which is L-shaped in cross section, is provided. Thus, the door anchoring section (bracket) 343 is rotatable about the shaft 342, more specifically, the axis (second axis D2 of rotation) of the shaft 342. That is, it is the door anchoring section (bracket) 343 to which the door 330 is fixed. In other words, the door 330 is supported by the shaft 342, which is protrusive from the arm 341, in such a manner that the door 330 is rotatable about the second axis D2 of rotation. In part (b) of FIG. 4, the hypothetical axis of rotation which coincides with the second axis D2, that is, a hypothetical axis of rotation, is designated by a referential code AX2.

Regarding the movement of the door 330, as the arm 341 supported by the supporting section 340 rotationally moves about the first axis D1 of rotation, following the first locus R1, the door 330 rotationally moves with the arm 341, about the first axis D1 of rotation shown in part (a) of FIG. 4.

Further, the door 330 rotationally moves with the arm 341, following the first locus shown in part (a) of FIG. 4. In order to prevent the arm 341 from disengaging from the through hole 340*a* of the supporting section 340 while the door 330 rotationally moves, one of the lengthwise ends of the arm 341 is provided with the stopper 341*a*. Further, the other end of the arm 341 is provided with the shaft 342, which perpendicularly protrudes inward from the arm 341. Therefore, it is possible for the door 330 to rotationally move about the shaft 342 (second axis D2 of rotation), following the second locus R2.

The shaft 342 with which the arm 341 is provided is fitted with a torsional coil spring 344 which functions as a pressure applying member. That is, the torsional coil spring 344 is supported by the shaft 342. One end 344*a* of the torsional coil spring 344 is engaged with the arm 341, and the other end 344*b* of the torsional coil spring 344 is engaged with the door anchoring section (bracket) 343. Thus, the door 330 always remains under the pressure generated by the resiliency of the torsional coil spring 344, in the opposite direction (in which door 330 is closed) from the direction indicated by an arrow mark R2, which also designates the second locus. That is, the door 330 always remains under the pressure generated by the torsional coil spring 344 in the direction to rotate the door 330 about the second locus R2 in the closing direction. The torsional coil spring 344 which functions as a pressure applying member is fitted between the door anchoring section (bracket) 343 and arm 341, and always keeps the door 330 under such pressure that works in the direction to prevent the door 330 from opening.

The door attachment bracket 343 to which the door 330 is attached remains pressured by the torsional coil spring 344 in the direction to prevent the door 330 from opening. That is, the door 330 remains pressured by the torsional coil spring 344 disposed between the arm 341 and door attachment bracket 343, in the direction to prevent the door 330 from opening. Therefore, unless the door 330 is subjected to such force (moment) that is greater than the pressure generated by the resiliency (moment) of the torsional coil spring 344, the torsional coil spring 344 prevents the door 330 from rotating in a manner to follow the second locus R2 shown in part (b) of FIG. 4.

Further, the door attachment bracket 343 fitted around the shaft 342 of the arm 341 in such a manner that it is allowed to rotate about the shaft 342 is regulated in the angle of its rotation by the rotation stopper 341*b*, with which the opposite end of the arm 341 from the door attachment bracket 343 is provided. That is, as the door attachment bracket 343 comes into contact with the rotation stopper 341*b*, it is prevented from rotating further in the opening direction. In other words, the rotation stopper 341*b* regulates the door attachment bracket 343 in the angle of its rotational movement.

Referring to part (b) of FIG. 2, in this embodiment, when the door 330 is opened while the sheet feeder tray 307 is completely inside the main assembly of the image forming apparatus 301, the door 330 always rotates following the first locus R1 shown in part (a) of FIG. 4.

However, it sometimes occurs that the door 330 is opened while the sheet feeder tray 307 is not completely inside the main assembly of the image forming apparatus 301, as shown in FIG. 3. In such a case, the door 330 rotates about the first axis D1 of rotation, shown in part (a) of FIG. 4, following the first locus R1, until the door 330 comes into contact with the sheet feeder tray 307.

If a user tries to further open the door 330 against the resiliency of the torsional coil spring 344 after the door 330 come into contact with the sheet feeder tray 307, the door 330 is subjected to a load, the amount of which equals to the force applied by the user to further open the door. Consequently, the door 330 is made to rotate about the second axis D2 of rotation, shown in part (b) of FIG. 4, following the second locus R2.

In this embodiment, the rotational axis of the door 330 switches between the first axis D1 of rotation and the second axis D2 of rotation based on the difference between the amount of the resiliency of the torsional coil spring 344 and the amount of force applied to the door 330 by the user. That is, as long as the door 330 does not come into contact with the sheet feeder tray 307 while it is opened, the amount of force to which the torsional coil spring 344 is subjected is smaller than the amount of the force generated by the resiliency of the torsional coil spring 344. In such a case, the arm 341 rotates about the first axis D1 of rotation, shown in part (a) of FIG. 4, following the first locus R1, and so does the door 330.

On the other hand, in a case where the door 330 comes into contact with the sheet feeder tray 307 while the door 330 is opened or closed, the torsional coil spring 344 is subjected to such an amount of force that is greater than the amount of force generated by the resiliency of the torsional coil spring 344. Thus, the door 330 rotates about the second axis D2 of rotation, shown in part (b) of FIG. 4, following the second locus R2.

FIG. 9 is a drawing illustrating a comparative image forming apparatus 301. If a user opens the door 330 while the sheet feeder tray 307 is not completely inside the main assembly of the image forming apparatus 301, it sometimes occurs that the door 330 comes into contact with the sheet feeder tray 307. If the user tries to further open the door 330 after the door 330 comes into contact with the sheet feeder tray 307, the force applied to the door 330 by the user is applied to the sheet feeder tray 307 through the door 330. In the case of the comparative image forming apparatus 301 shown in FIG. 9, the impactive force generated by the abrupt contact between the door 330 and sheet feeder tray 307 is entirely transmitted to the sheet feeder tray 307. Thus, the sheet feeder tray 307 is subjected to a large amount of force.

In comparison, in the case of the image forming apparatus 301 in this embodiment, until the door 330 comes into contact with the sheet feeder tray 307, the door 330 rotates with the arm 341 about the first axis D1 of rotation, following the first locus R1, as shown in part (a) of FIG. 4, as in the case of the comparative image forming apparatus 301.

Then, as such an amount of force that is greater than the force generated by the resiliency of the torsional coil spring 344 is applied to the door 330 against the resiliency of the torsional coil spring 344, the door 330 rotates about the second axis D2 of rotation, following the second locus R2, as shown in part (b) of FIG. 4. Thus, the impact which occurs as the door 330 comes into contact with the sheet feeder tray 307 is reduced. Therefore, the force to which the sheet feeder tray 307 is subjected as the door 330 comes into contact with the sheet feeder tray 307 while the door 330 is opened is significantly smaller than in the case of the comparative image forming apparatus 301.

According to this embodiment, as the door 330 comes into contact with the sheet feeder tray 307 while the door 330 is opened or closed, the rotational axis of the door 330 shifts from the first axis D1 of rotation, shown in part (a) of FIG. 4, to the second axis D2 of rotation shown in part (b) of FIG. 4. Thus, it does not occur that the force applied to the door 330 to open the door 330 is entirely transmitted to the sheet feeder tray 307. Therefore, the load to which the sheet feeder tray 307 is subjected is significantly smaller than in the case of the comparative image forming apparatus 301 (any conventional image forming apparatus).

[Embodiment 2]

Next, referring to FIGS. 5 and 6, the image forming apparatus 301 in the second embodiment of the present invention is described about its structure. The components of the image forming apparatus 301 in this embodiment, which are the same in structure as the counterparts in the first embodiment are given the same referential codes as the counterparts, and are not described here. Further, even if a component of the image forming apparatus 301 in this embodiment is different in referential code from the counterpart in the first embodiment, it is not described as long as the two components are the same in structure.

In the first embodiment, the torsional coil spring 344 which functions as a pressure applying member is fitted around the shaft 342. Further, one end 344*a* of the torsional coil spring 344 is anchored to the rotational arm 341, and the other end 344 is anchored to the door attachment bracket 343. In other words, the image forming apparatus 301 in the first embodiment was structured so that the pressure generated by the resiliency of the torsional coil spring 344 is applied in the direction to prevent the door 330 from opening.

Referring to part (b) of FIG. 5, in this embodiment, a torsional coil spring 444 is fitted around the shaft 342. One end 444*a* of the torsional coil spring 444 is anchored to the shaft 342 by being inserted into a groove 342*a* with which the shaft 342 is provided, and the other end 344*b* is anchored to the door attachment bracket 343. Thus, the force generated by the resiliency of the torsional coil spring 444 is made to work in the direction to prevent the door 330 from opening. Otherwise, the image forming apparatus 301 in this embodiment is the same in structure as that in the first embodiment. Thus, this embodiment can provide the same effects as the first embodiment.

[Embodiment 3]

Next, referring to FIGS. 7 and 8, the image forming apparatus in the third embodiment of the present invention is described about its structure. By the way, the components of the image forming apparatus 301 in this embodiment, which are the same in structure as the counterparts in each of the preceding embodiments are given the same referential codes as the counterparts, and are not described here. Further, even if a component of the image forming apparatus 301 in this embodiment is different in referential code from the counterpart in the first embodiment, it is not described as long as the two components are the same in structure.

Referring to FIGS. 7 and 8, a supporting section (bracket) 540 which is solidly attached to the main assembly of the image forming apparatus 301 is provided with a through hole 540*a* which extends in the vertical direction of part (a) of FIG. 8 and part (b) of FIG. 8. The arm 541 to which the door 330 is attached so that the door 330 can be pivotally moved (opened or closed) relative to the main assembly of the image forming apparatus 301 is provided with a shaft 541*a*, which horizontally protrudes from one end of the arm 541, and which is put through the above described through hole 540*a* in such a manner that it is allowed to vertically move though the hole 540*a*.

It is to the other end of the arm 541 that the door 330 is solidly attached by a door bracket section 541*b* of the arm 541. Thus, the door 330 is supported by the arm 540 in such a manner that it is rotationally movable about the axis D3 of the shaft 541*a*, as shown in part (a) of FIG. 8, following the first locus R3, shown in part (a) of FIG. 8.

Further, the image forming apparatus 301 is structured so that the shaft 541*a* with which the arm 541 is provided is allowed to move in the direction indicated by an arrow mark E in part (b) of FIG. 8, following the through hole 540*a*. Moreover, there is disposed a coil spring 544 which functions as a pressure applying means, between one end (top end in part (a) of FIGS. 8 and 8(*b*) of the elongated hole 540*a*, and the peripheral surface of the shaft 541*a*.

Thus, the shaft 541*a* always remains pressured by the resiliency of the coil spring 544 in the opposite direction from the direction indicated by the arrow mark E in part (b) of FIG. 8. Thus, unless a force which is greater than the expansionary resiliency of the coil spring 544 acts on the door 330, the coil spring 544 prevents the shaft 541*a* from moving in the direction indicated by the arrow mark E in part (a) of FIG. 8. That is, such a force that acts in a manner to regulate the opening of the door 330 is applied to the door 330 by the coil spring 544 disposed between the supporting section 540 with which the main assembly of the image forming apparatus 301 is provided, and the arm 541. Thus, as the door 330 is rotationally (pivotally) moved, the shaft 541*a* moves through the elongated through hole 540*a*, remaining under the pressure generated by the resiliency of the coil spring 544.

Referring to FIG. 7, because the image forming apparatus 301 is structured as described above, it sometimes occurs that the door 330 is opened while the sheet feeder tray 307 is not completely inside the main assembly of the main assembly of the image forming apparatus 301. In such a case, the door 330 rotationally (pivotally) moves about the axis D3 of the shaft 541*a*, following the first locus R3, shown in part (a) of FIG. 8, until the door 330 comes into contact the sheet feeder tray 307.

If a user applies a certain amount of force to the door 330 to further open the door 330 while the door 330 is in contact with the sheet feeder tray 307, the door 330 rotationally (pivotally) moves while causing the shaft 541*a* to move in the direction indicated by the arrow mark E in part (b) of FIG. 8, following the elongated through hole 540*a*, against the force generated by the resiliency of the coil spring 544.

That is, in a case where the door 330 does not come into contact with the sheet feeder tray 307 while the door 330 is opened or closed, the force which acts on the door 330 is smaller than the force generated by the resiliency of the coil spring 544. Thus, the door 330 rotationally moves about the axis D3, without causing the shaft 541*a*, which is under the pressure generated by the coil spring 544, to move following the elongated through hole 540*a*.

On the other hand, in a case where the door 330 comes into contact with the sheet feeder tray 307 while it is opened or closed, such a force that is greater than the pressure generated by the expansionary resiliency of the coil spring 544 acts on the door 330. Thus, the door 330 rotates while causing the shaft 541*a* to move in the direction indicated by the arrow mark E in part (b) of FIG. 8 along the elongated through hole 540*a*, against the force generated by the expansionary resiliency of the coil spring 544.

That is, the rotational movement of the door 330 against the force generated by the resiliency of the coil spring which functions as a pressure applying means is as follows. Until the door 330 comes into contact with the sheet feeder tray 307, the shaft 541 does not moves along the elongated through hole 540*a*, and the door 330 rotates about the shaft 541 (pivots about axis of shaft 541). As the door 330 is opened further, the shaft 541*a* is moved upward along the elongated through hole 540*a*, and the door 330 rotates about the axis of the upwardly moving shaft 541*a*, as shown in part (b) of FIG. 8.

In the case of the comparative image forming apparatus 301 structured as shown in FIG. 9, the impact generated as the door 330 comes into contact with the sheet feeder tray 307 is entirely transmitted to the sheet feeder tray 307. Thus, the sheet feeder tray 307 is subjected to a significant amount of force. In comparison, in this embodiment, as a user applies force (load) to the door 330 to further open the door 330 after the door 330 came into contact with the sheet feeder tray 307, the shaft 541*a* moves in the direction indicated by the arrow mark E in part (b) of FIG. 8 along the elongated through hole 540*a*, against the force generated by the resiliency of the coil spring 544.

Therefore, in the case of the image forming apparatus 301 in this embodiment, the impact which occurs as the door 330 comes into contact with the sheet feeder tray 307 is not as large as that in the case of the comparative image forming apparatus 301. Therefore, the force which applies to the sheet feeder tray 307 in the case of the image forming apparatus 301 in this embodiment is not as large as that in the case of the comparative image forming apparatus 301. By the way, instead of the coil spring 544, an elastic component, the resiliency of which acts in its lengthwise direction, may be disposed between the top wall of the elongated through hole 541*a* (top end in parts (a) and (b) of FIG. 8), and the peripheral surface of the shaft 541*a*. The effects of such a structural arrangement are the same as that of the image forming apparatus 301 in this embodiment. Otherwise, the structure of the image forming apparatus 301 in this embodiment is the same as that of the image forming apparatus 301 in each of the preceding embodiments. Further, the effects of this embodiment are the same as any of the preceding embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-163549 filed on Aug. 11, 2014, which is hereby incorporated by reference herein in its entirety.

What is claimed is:

1. An image forming apparatus comprising:

a main assembly;

a rotatable member supported by the main assembly rotatably about a first rotational center;

an openable member supported by the rotatable member rotatably about a second rotational center;

a feeding cassette detachably provided on the main assembly and configured to accommodate recording material; and an urging member provided between the openable member and the rotatable member and configured to apply an urging force for suppressing opening of the openable member, wherein when the openable member does not contact the feeding cassette in an opening and closing operation of the openable member, the rotatable member rotates about the first rotational center to rotate the openable member, and when the opening member contacts the feeding cassette in the opening and closing operation of the openable member, the openable member rotates about the second rotational center.

2. An apparatus according to claim 1, wherein when the openable member moves in a direction of opening relative to the main assembly about the first rotational center, the openable member is urged in a direction of closing relative to the main assembly by the urging member, and when the openable member moves in the direction of opening relative to the main assembly about the second rotational center, the openable member moves against an urging force of the urging member.

3. An apparatus according to claim 1, wherein the rotatable member is curved with a predetermined radius about the first rotational center as viewed in an axial direction through a rotational center of the rotatable member.

4. An apparatus according to claim 1, wherein the main assembly includes a supporting portion supporting the rotatable member, and the rotatable member is slidable relative to a hole portion of the supporting portion.

5. An apparatus according to claim 4, wherein the rotatable member is provided at each of two end portions with a rotation stop to prevent passage through the hole portion.

6. An apparatus according to claim 5, wherein the rotatable member is provided with a rotational shaft portion at one of the two end portions.

7. An apparatus according to claim 6, wherein the second rotational center is on the rotational shaft portion.

8. An apparatus according to claim 7, wherein the urging member includes a torsion coil spring supported by the rotational shaft portion.

9. An apparatus according to claim 1, wherein when a process cartridge including a photosensitive member is mounted and demounted relative to the main assembly, the openable member moves in a direction of opening the main assembly.

10. An image forming apparatus comprising:

a main assembly;

an openable member openable and closable relative to the main assembly;

a rotatable member configured to rotate the openable member relative to the main assembly;

a hole portion which is provided in the main assembly and through which a rotational shaft portion of the rotatable member is slidably inserted; and an urging member provided between the main assembly and the rotatable member and configured to apply an urging force for suppressing opening of the openable member, wherein the rotation of the openable member is switched in response to an urging force of the urging member between rotation about the rotational shaft portion without movement along the hole portion and rotation about the rotational shaft portion with movement along the hole portion.

11. An apparatus according to claim 10, wherein when a force not larger than the urging force of the urging member is applied to the openable member in an opening and closing operation of the openable member, the openable member rotates about the rotational shaft portion urged by the urging member without movement of the rotational shaft along the hole portion, and when a force larger than the urging force of the urging member is applied to the openable member in the opening and closing operation of the openable member, the openable member rotates against the urging force of the urging member with movement of the rotational shaft portion along the hole portion.

12. An apparatus according to claim 11, further comprising a feeding cassette detachably provided on the main assembly and configured to accommodate recording material, when the openable member does not contact the feeding cassette in the opening and closing operation of the openable member, the openable member rotates against the urging force of the urging member with movement of the rotational shaft portion along the hole portion.

13. An image forming apparatus comprising:

a main assembly;

a rotatable member supported by the main assembly rotatably about a first rotational center;

an openable member supported by the rotatable member rotatably about a second rotational center; and an urging member provided between the openable member and the rotatable member and configured to apply an urging force for suppressing opening of the openable member, wherein the openable member is capable of switching a rotational center between the first rotational center and the second rotational center in an opening and closing operation of the openable member, and wherein the rotatable member is curved with a predetermined radius about the first rotational center as viewed in an axial direction through the rotational center of the rotatable member.

* * * * *